US006196428B1

(12) United States Patent
Robak

(10) Patent No.: US 6,196,428 B1
(45) Date of Patent: Mar. 6, 2001

(54) COMBINATION CAP HANGER AND CAP BRIM CURVING DEVICE

(76) Inventor: Thomas J. Robak, 84 Nelson St., Suite 176, Chicopee, MA (US) 01013

( * ) Notice: Subject to any disclaimer, the term of this patent is extended or adjusted under 35 U.S.C. 154(b) by 0 days.

(21) Appl. No.: 09/567,960

(22) Filed: May 9, 2000

(51) Int. Cl.[7] ..... A42C 1/00
(52) U.S. Cl. ..... 223/24; 223/85
(58) Field of Search ..... 223/24, 25, 85, 223/92, DIG. 2

(56) References Cited

U.S. PATENT DOCUMENTS

| | | | | |
|---|---|---|---|---|
| D. 81,025 | * | 4/1930 | Salzman | 223/85 |
| D. 165,988 | * | 2/1952 | Kupchik | 223/92 |
| 2,419,723 | * | 4/1947 | Mack, Sr. | 223/96 |
| 2,457,486 | * | 12/1948 | O'Grady | 223/85 |
| 2,548,778 | * | 4/1951 | Douglas | 223/85 |
| 2,786,615 | * | 3/1957 | Saibene | 223/24 |
| 3,720,324 | * | 3/1973 | Berkowitz | 211/45 |
| 3,993,195 | * | 11/1976 | Caligiuri | 211/7 |
| 4,454,969 | * | 6/1984 | Huth | 223/96 |

* cited by examiner

*Primary Examiner*—Bibhu Mohanty
(74) *Attorney, Agent, or Firm*—Albert O. Cota

(57) ABSTRACT

A combination cap hanger and cap brim curving device (10) that is especially designed to hold and display a "baseball-type" hat (40) while retaining the cap brim (42) at an angle of 176°. The device (10) consists of an integrally molded, rectangular arched body (12) having a middle portion (14), a first end (16) and a second end (18). From the middle portion (14) extends upward a hook (20) that is configured and dimensioned to allow the device (10) to be hung on a conventional clothes hanging rod (44). The device (10) features, near each end (16, 18) a circular, hollow sleeve (24). The sleeves (24) are each dimensioned to allow the cap brim (42) to be inserted into the sleeve (24) with the portion of the cap (40) adjacent the brim (42) resting and displayed above the surface of the sleeve (24).

17 Claims, 4 Drawing Sheets

COMBINATION CAP HANGER AND CAP BRIM CURVING DEVICE

TECHNICAL FIELD

The invention pertains to the general field of hat and cap hangers, and more particularly to a cap hanger which holds and displays at least two caps while maintaining the brims of the caps at a preferred curve of 176°.

BACKGROUND ART

One of the most widely used items of apparel is a hat, especially baseball-type caps. In addition to being used by sports teams during athletic events, baseball caps are worn by both men and women as part of their general wardrobe. Some of the reasons for the popularity of baseball caps are that they are lightweight and comfortable to wear, they come in almost any color and may include indicia which promotes a person's particular like, and they do not require much care to maintain in good condition.

Unfortunately, it is a result of this last reason that certain individuals require a solution to a problem. While baseball caps do not require much care, many people quickly destroy their caps due to severe mis-handling. As a result of their design, baseball caps are often simply thrown about or even folded or smashed when not being worn. Although many baseball caps can withstand this abuse up to a point, after an extended duration the caps become disfigured and un-wearable. Also, after repeated washing, or exposure to rain, when caps are simply left as-is to dry, they can become disfigured.

Obviously, if there were some way to store baseball caps, which would allow the caps to be maintained in a position similar to that of being worn on a person's head and that could keep the cap's brim at an angle of 176° for optimum sun-shading capability, it would be a beneficial. Additionally, it would be helpful if the caps could be stored along with a person's other clothes, while utilizing existing space, such as in a closet.

A search of the prior art did not disclose any patents that read directly on the claims of the instant invention however, the following U.S. patents were considered related:

| PAT. NO. | INVENTOR | ISSUED |
|---|---|---|
| 5,991,927 | Barbaccia | Nov. 30, 1999 |
| 5,685,465 | Berardis | Nov. 11, 1997 |
| 5,533,652 | Levin | July 9, 1996 |

The U.S. Pat. No. 5,991,927 discloses a device that is comprised of a bill-shaping well with a bill locking portion at each of its first and second terminal ends. The bill of a cap fits into the device such that the bill locking portions frictionally hold the bill against the bill-shaping wall, thereby shaping the bill into the shape of the bill-shaping wall. The bill-support wall preferably further includes indicia and a transparent plastic card-holder for storing and displaying a baseball card.

The U.S. Pat. No. 5,685,465 discloses a brim-shaping device for a baseball-type cap. The device is designed to create and maintain a desired curvature of the cap brim. The device is comprised of a mold that has a substantially hollow, curved body, and a curved shaping slot for insertion of the cap brim into the hollow, curved body. The mold may have slots running along its sides to allow for aeration of the cap when it is wet. The hollow mold is shaped to present the cap at a given angle, so that the cap portion is displayed above the brim as it rests in the shaping slot. The mold itself is attachable to a display rack, so that the shaping device can also double as a merchandising tool during the sale of the cap.

The U.S. Pat. No. 5,533,652 discloses a device for bowing the brim of a cap and storing, transporting and/or displaying a cap. The device is comprised of a central body portion extending downward on each side and terminating with upward extending retention arms at each side thereof forming first and second receipt areas for the first and second side of the cap brim. The design of the central body causes the brim to be formed into a desired curve with an elastic band extending over the top of the brim from the first retention arm to the second retention arm. Slots can be disposed inward of one of the receipt areas allowing one side of the brim to form alternate brim receipt areas for different desired brim curvatures.

DISCLOSURE OF THE INVENTION

The combination cap hanger and brim curving device is designed to hold and display at least two "baseball-type" caps. While the caps are held on the device, the brims of the caps are maintained at a curved angle of 176°. Thus, when the caps are removed from the device, the brims substantially remain at the preferred 176° curve.

In its most basic design, the device is comprised of:

A. A substantially rectangular arched body having a middle portion, a first end and a second end, B. An upstanding hook disposed at right angles to the body on the middle portion. The hook is configured to removably attach and retain the device on a receptacle such as a clothes rod, and C. At least one circular hollow sleeve formed on each end of the body. Each sleeve has a diameter that is dimensioned to hold the cap with the cap brim rolled inward in a circular direction and inserted therethrough.

The arched body is inwardly tapered from the center of the middle portion to form an arch of 120°. The two ends of the body are each tapered and terminate with a point to add to the aesthetics of the device. The upstanding hook, which distends upward from a top side of the arch on the body, has an internal radial curve. This curve is proportioned to allow an interface with a clothes rod as typically found in a closet.

The preferred overall length of the device is 17.296 inches (43.932 cm) with the circular hollow sleeves having a preferred internal diameter of 2.850 inches (7.24 cm) and a depth of 1.50 inches (3.81 cm).

In view of the above disclosure, it is the primary object of the invention to produce a combination cap hanger and cap brim curving device that holds and displays "baseball-type" caps while maintaining the curve of the cap brim at a 176° angle.

In addition to the primary object of the invention it is also an object of the invention to produce a device that:

has a shape and dimensions that are similar to the general shape and dimensions of a typical clothes hanger. Thus, the device can be hung on a conventional clothes rod and commingled amongest other hung clothes found in a closet.

has a pleasing and aesthetic shape, can be designed to accommodate at least two caps, can be produced from a variety of materials including plastic, wood, metal and cardboard, can be produced in a variety of colors to compliment a particular team color/cap, allows a washed cap to drain of water, allows the device to function as a means for merchandising and/or displaying the cap, and is cost effective from both a consumer and a manufacturers point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 10:
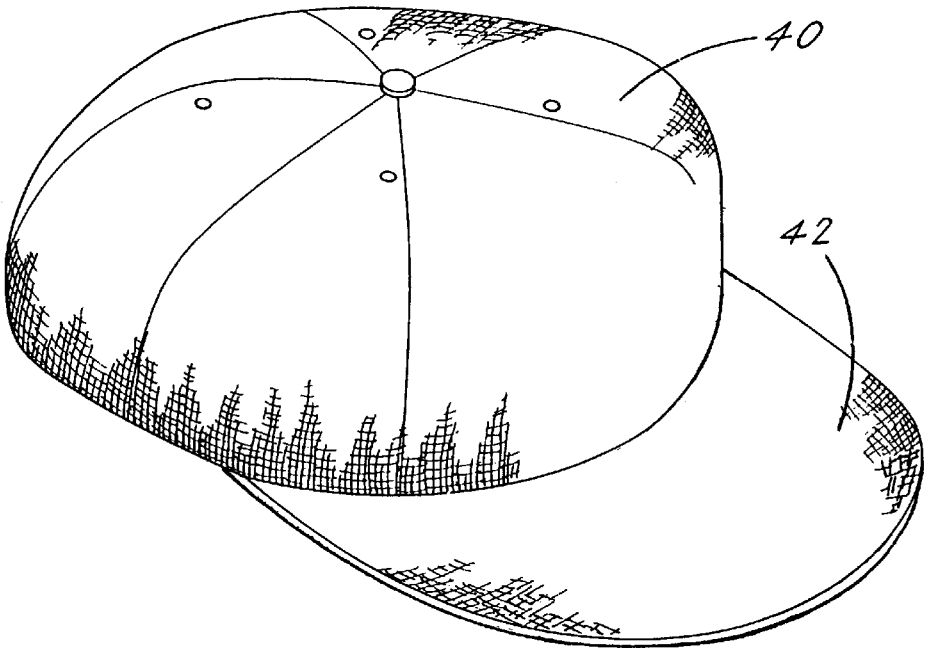
FIG. 10 PRIOR ART
FIG. 10 is a perspective view of a typical baseball-type cap.
Figure 11:
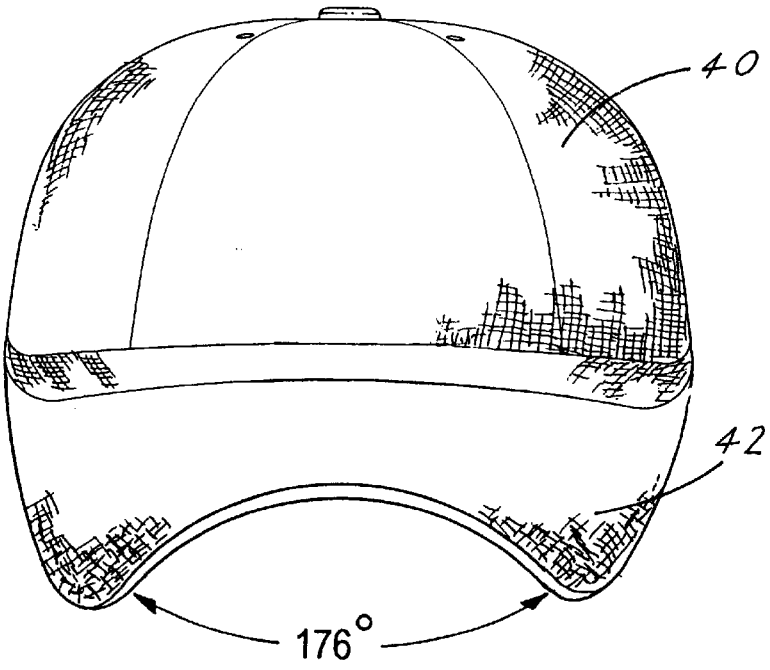
FIG. 11 is a front elevational view of the baseball-type cap shown with the brim angled at 176°.

The best mode for carrying out the invention is presented in terms of a preferred embodiment for a cap hanger and cap brim curving device 10, hereinafter "device 10". The device 10, as shown in FIGS. 1–9 is designed to allow at least two baseball-type caps 40, as shown in FIGS. 10 and 11, to be held in place by use of the cap's brim 42. The device 10 is comprised of the following major elements: a body 12, an upstanding hook 20 and a circular hollow sleeve 24.

The body 12, as shown in FIGS. 1–9 is substantially rectangular and is comprised of a middle portion 14, a first end 16 and a second end 18. The body 12 is arched essentially 120 degrees, is inwardly tapered on the middle portion 14, and is tapered to a point on each end 16, 18.

Figure 4:
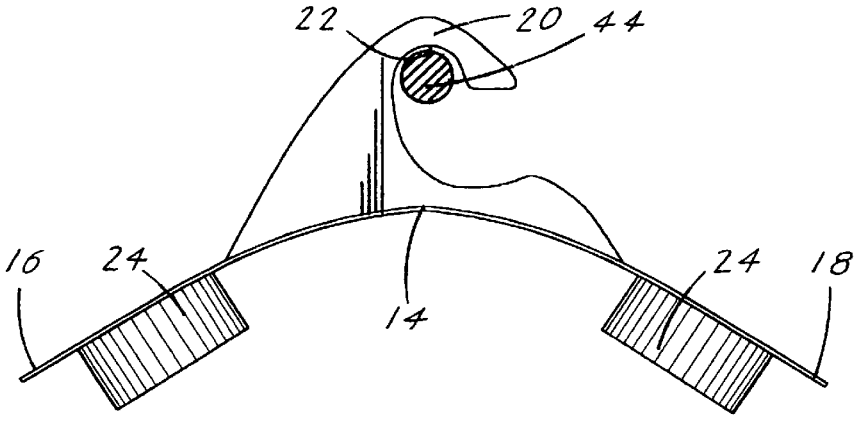
FIG. 4 is a front elevational view of the device.
Figure 5:
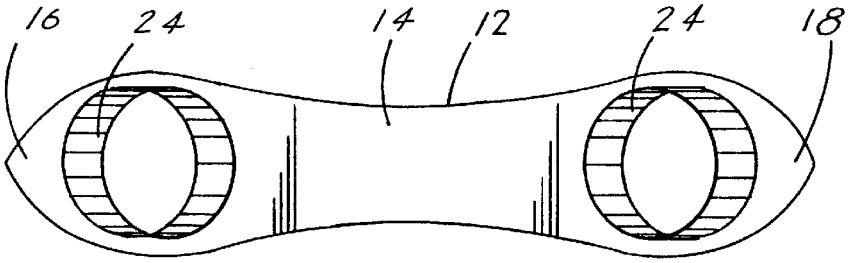
FIG. 5 is a bottom plan view of the device.
Figure 6:
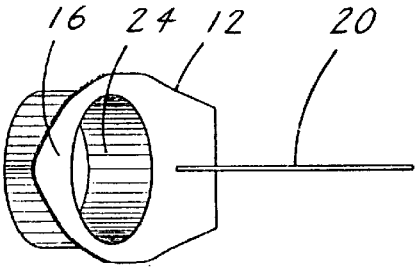
FIG. 6 is a left-side elevational view of the device.
Figure 7:
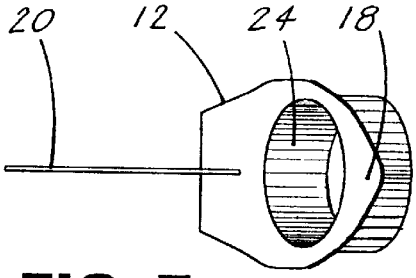
FIG. 7 is a right-side elevational view of the device.
Figure 8:
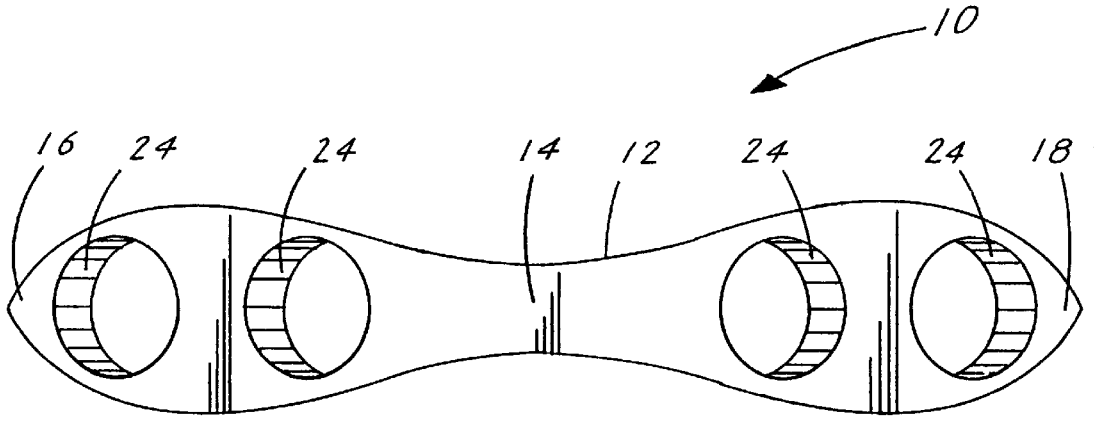
FIG. 8 is a top plan view of a device that incorporates two sleeves on each end of the arched body.
Figure 9:
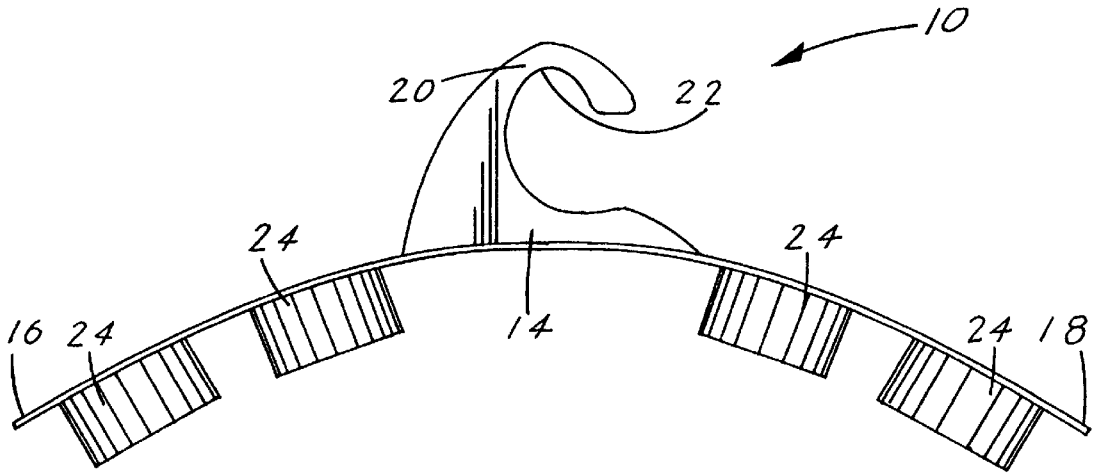
FIG. 9 is a front elevational view of the device that incorporates two sleeves on each end of the arched body.

The upstanding hook 20, as shown in FIGS. 1, 2, 4 and 9, is disposed at right angles to the body 12 on the middle portion 14, and is configured to removably attach and retain the device 10 on a receptacle such as a clothes rod 44 as shown in FIG. 4. Further, the hook 20 distends upward from a top side of the arch on the body 12, and the hook has an internal radical curve 22, which is proportioned to interface with the clothes rod 44 as shown in FIG. 4.

Figure 1:
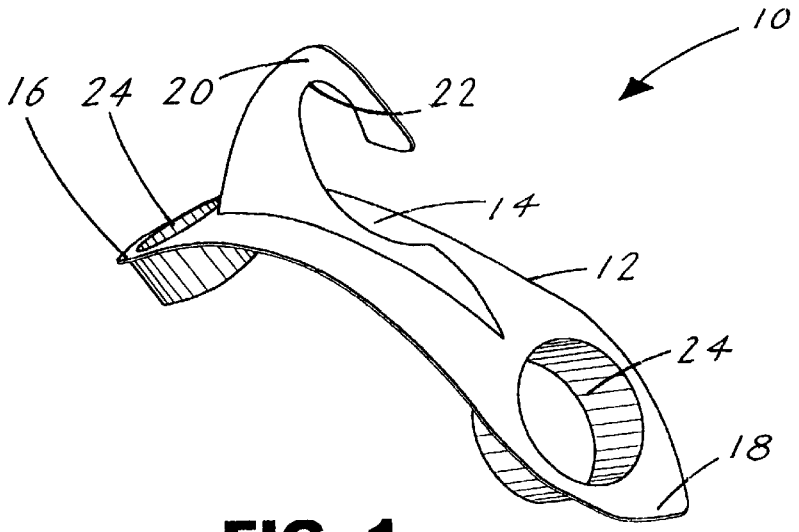
FIG. 1 is an axonometric view of a combination cap hanger and cap brim curving device which includes a substantially rectangular arched body having a middle portion, a first end and a second end. Extending upward from the middle portion is a hook and near each of the ends is located a circular hollow sleeve.
Figure 2:
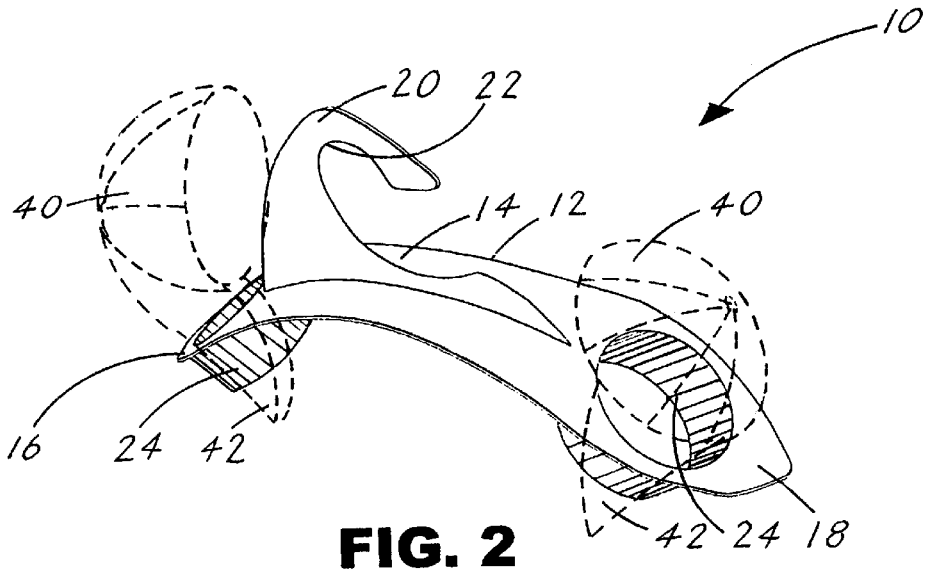
FIG. 2 is an axonometric view of the device with a cap inserted into each of the sleeves. For clarity, the caps are shown in broken lines.
Figure 3:
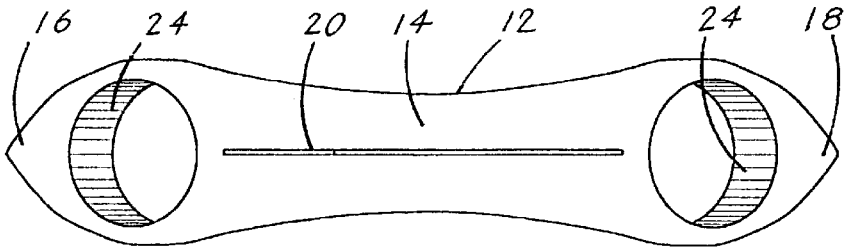
FIG. 3 is a top plan view of the device.

As shown in FIGS. 1–9 at least one of the circular hollow sleeves 24 is formed into each end 16, 18 of the body 12. The sleeve 24 has a diameter which is sufficient to hold a cap 40, when the cap's brim 42 is rolled in a circular direction and inserted therethrough as shown in FIG. 2. In order to accommodate the brim 42 of a cap 40, the sleeve has an internal diameter of from 2.50 inches (6.35 cm) to 3.00 inches (7.62 cm), with a preferred upper internal diameter of 2.85 inches (7.25 cm) and a preferred lower internal diameter of 2.651 inches (6.734 cm). The smaller, lower diameter is provided to facilitate the removal of the device 10 from the mold.

The sleeve 24 has a depth of from 1.25 inches (3.18 cm) to 1.75 inches (4.45 cm), with 1.5 inches (3.81 cm) preferred. The overall length of the device 10, which incorporates one sleeve 24 at each end, is between 16 inches (40.64 cm) and 18 inches (45.72 cm), with a preferred overall length of 17.296 inches (43.932 cm).

The device 10 can be constructed from a variety of materials, such as wood, metal or cardboard, but it is preferred that the body 12, hook 20 and sleeves 24 be integrally formed and injection molded from thermoplastic.

To use the combination cap hanger and cap brim curving device 10 for storing a baseball-type cap while simultaneously curving its brim to essentially 176 degrees, as shown in FIG. 11, the following steps are performed:

1. bend the cap brim 42 by hand into an inward curve,
2. insert the bend cap brim 42 into one of the circular hollow sleeves 24 attached to a body 12,
3. release the cap brim 42 while the brim is in the sleeve 24 such that the bent brim 42 of the cap 40 holds the cap in place and maintains the cap brim at the preferred 176 degrees curve, and
4. hang and store the device 10 on a clothes rod.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

What is claimed is:

1. A combination cap hanger and cap brim curving device comprising:

a) a substantially rectangular arched body having a middle portion, a first end and a second end, b) an upstanding hook disposed at right angles to said body on the middle portion, configured to removably attach and retain said device on a receptacle, and c) at least one circular hollow sleeve formed into each end of the body, said sleeve having a diameter dimensioned to hold said cap with the brim rolled inward in a circular direction and inserted therethrough.

2. The device as recited in claim 1 wherein said body is arched at essentially 120 degrees.

3. The device as recited in claim 1 wherein said body is inwardly tapered on the middle portion.

4. The device as recited in claim 1 wherein said body is tapered to a point on each end.

5. The device as recited in claim 1 wherein said upstanding hook distends upward from a top side of the arch on the body.

6. The device as recited in claim 1 wherein said upstanding hook has an internal radial curve proportioned to interface with said receptable.

7. The device as recited in claim 6 wherein said receptable comprises a clothes hanging rod.

8. The device as recited in claim 1 wherein said circular hollow sleeve having an internal diameter of from 2.50 inches (6.35 cm) to 3.0 inches (7.62 cm).

9. The device as recited in claim 1 wherein said circular hollow sleeve having a preferred upper internal diameter of 2.850 inches (7.25 cm) and a lower internal diameter of 2.651 inches (6.734 cm).

10. The device as recited in claim 1 wherein said circular hollow sleeve having a depth of from 1.25 inches (3.18 cm) to 1.75 inches (4.45 cm).

11. The device as recited in claim 1 wherein said circular hollow sleeve has a preferred depth of 1.50 inches (3.81 cm).

12. The device as recited in claim 1 wherein said device has an overall length between 16 inches (40.64 cm) and 18 inches (45.72 cm).

13. The device as recited in claim 1 wherein said device has a preferred overall length of 17.296 inches (43.932 cm).

14. The device as recited in claim 1 wherein said body, hook and sleeves are integrally formed and injection molded from thermoplastic.

15. A process for storing a "baseball-type" cap while simultaneously curving its brim to essentially 176 degrees, said process comprising the following steps:

a) bending the cap brim by hand into an inward curve, b) inserting the bent cap brim into a circular hollow sleeve attached to a body having a hanger, and c) releasing the cap brim while in the sleeve such that the bent brim of the cap holds the cap in place and maintains the cap brim at the preferred 176 degree curve.

16. The process as specified in claim 15 further comprising the step of hanging said hanger on a clothes rod for storage.

17. The process of storing a "baseball-type" cap while simultaneously curving its brim to essentially 176 degrees as recited in claim 15 wherein said hanger is produced by application of the following steps:

a) mold an essentially rectangular arched body having:

(1) a middle portion, (2) a first end and a second end, (3) an upstanding hook disposed at right angles to the body on the middle portion, configured to removably attach and retain the device on a receptable, wherein said hook is dimensioned and configured to removably attach and retain said device on a receptable, and (4) at least one circular hollow sleeve formed into each end of said body and having a diameter sufficient to hold a cap having a projecting sun shading brim, when the brim is rolled in a circular direction and inserted therethrough, and b) remove said cap from said sleeve, wherein when removed the cap brim is set at the 176° curve.

* * * * *